United States Patent [19]

Stenger

[11] Patent Number: 4,696,491

[45] Date of Patent: Sep. 29, 1987

[54] INFORMATION REFERENCE BOOK AND INDEXING SYSTEM

[76] Inventor: Barbara J. Stenger, P.O. Box 403, Brimfield, Ill. 61517

[21] Appl. No.: 875,947

[22] Filed: Jun. 19, 1986

[51] Int. Cl.[4] ..... B42F 21/00; B42F 19/00; B42F 13/00

[52] U.S. Cl. ..... 283/37; 283/38; 283/42

[58] Field of Search ..... 283/31, 32, 33, 35, 283/36, 37, 38, 39, 40, 41, 42, 43; 281/21 A, 21 R, 22, 3 R; 206/450; 248/441.1; 116/234

[56] References Cited

U.S. PATENT DOCUMENTS

| | | | |
|---|---|---|---|
| 1,069,092 | 7/1913 | Wise | 283/37 |
| 2,986,144 | 5/1961 | Shepard | 283/38 |
| 3,110,508 | 11/1963 | Sendor | 283/42 |
| 3,754,778 | 8/1973 | Lenaham | 283/38 |
| 4,573,821 | 3/1986 | Gilreath | 283/42 |

*Primary Examiner*—E. R. Kazenske
*Assistant Examiner*—Paul M. Heyrana, Sr.
*Attorney, Agent, or Firm*—Ralph E. Walters

[57] ABSTRACT

The present invention relates to an Information Reference Book and Indexing System and is specifically concerned with providing a loose-leaf binder, having a plurality of alphabetical sections and a supply of preprinted abstract pages in a separate appendix section of the binder individually providing titled spaces for conveniently recording the most pertinent information concerning the material selected for storing and ready retrieval. Prior art devices and systems have required hand copying of the entire article or recipe with opportunity for mistakes to be carried forward to subsequent copies thereof. With the present invention a particular recipe or article which is only hazily remembered can be dependable and quickly located and retrieved with a minumum of searching time required.

11 Claims, 3 Drawing Figures

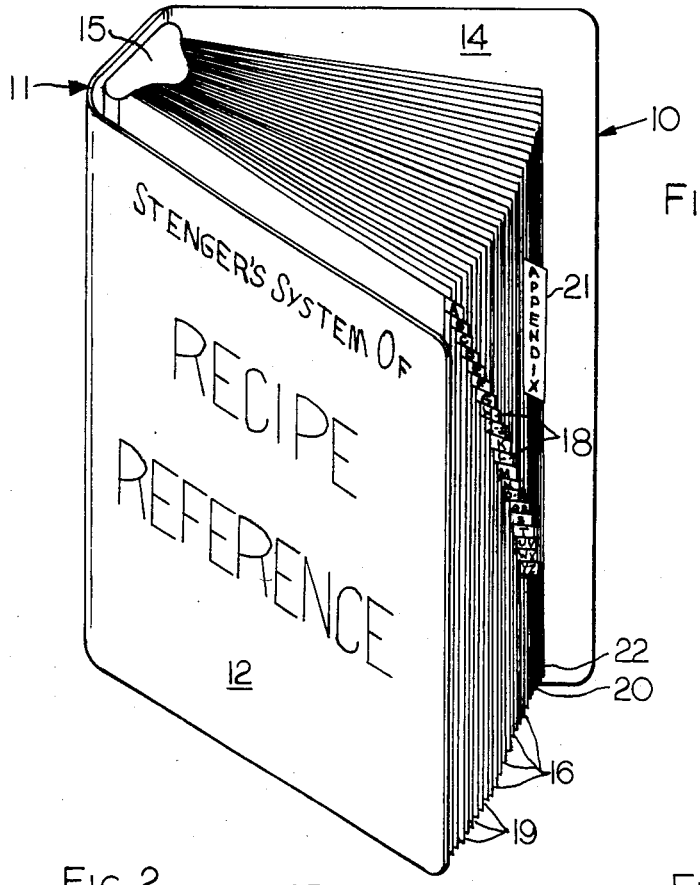
FIG. 1
FIG. 2
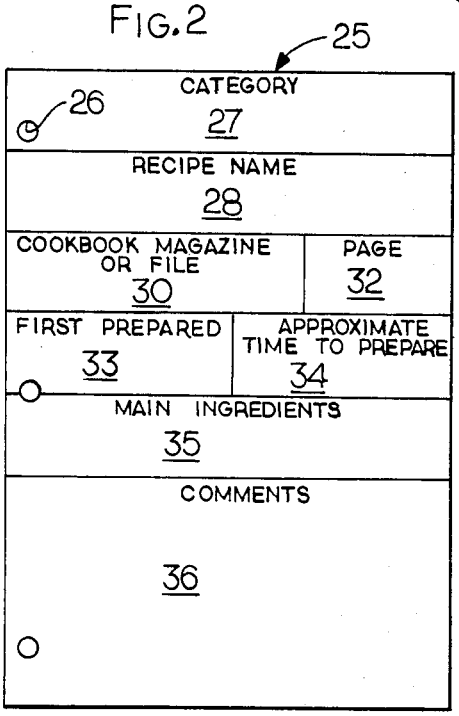
FIG. 3
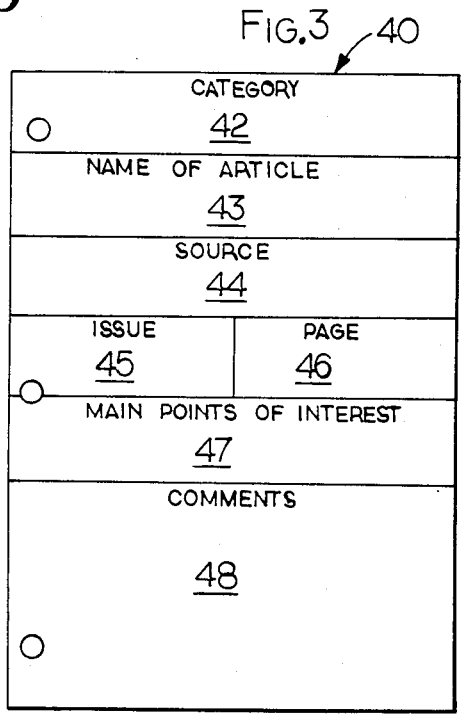

INFORMATION REFERENCE BOOK AND INDEXING SYSTEM

DESCRIPTION

1. Technical Field

The present invention generally relates to an information reference book and more particularly to a book for preparing and storing abstracts of selected magazine or newspaper articles, favorite recipes and the like.

2. Background Art

Hobbyist and homemakers are probably two of the most active information gathers and savers in the ordinary conduct of their daily lives. Homemakers, responsible for the daily cooking chores, providing meals for their families, continually peruse the newspapers, magazines, cookbooks and other publications for new, interesting and appetizing recipes. Cookbooks, in thousands of formats, have been published over the years and collected by homemakers and cooks with much the same intensity as numismatics collect rare coins, never knowing when a particular item will be useful in rounding out a particular collection or food item to complement a selected menu for a special dinner party or the like. In such event, the homemaker is usually frustrated by having to laboriously search through the entire library of cookbooks and magazines to try and find that one special recipe, the location of which is long forgotten. Thus far, in order to avoid this procedure, homemakers have usually followed a system wherein the entire recipe is tediously clipped intact from a particular source and some attempt made to categorize it for storage in a box or other container frequently ill-suited for the purpose. Even if the container is alphabetized, the sections become so crowded and cluttered that it is difficult to stuff additional material into them which frequently become folded, creased or torn before any attempt is made to retrieve the material. This makes such retrieval all the more onerous in trying to locate the hazily remembered recipe at some date years following its collection and storage within such unorganized mass of material. Other past practices have included using an alphabetized index for recording recipes which are stored in a conventional recipe box made specifically for this purpose. These, however, require the entire recipe to be hand copied onto the card from the source, which is very tedious and time consuming. Furthermore, mistakes can be made during the recording procedure that may be repeated as additional copies are made that can be avoided by using the originally published recipe everytime that it is prepared. It is therefore recognized that an improved information reference book is desirable which may be adapted to provide a handy reference for ensuring that a selected recipe or other bit of original information can be immediately identified and located from a data bank or other source and utilized in its original form to minimize mistakes. Accordingly, the present invention is directed to overcoming the problems as set forth above.

DISCLOSURE OF THE INVENTION

In accordance with one aspect of the present invention, there is provided an information reference book and indexing system which utilizes a loose-leaf binder, having a plurality of alphabetical sections and a supply of preprinted abstract pages in an appendix section of the binder individually providing titled spaces for conveniently recording the most pertinent information from the material selected for storage and ready retrieval, together with new and original editorial comments pertinent to such original material.

BRIEF DESCRIPTION OF THE DRAWINGS

FIG. 1 is a three-dimensional view of a loose-leaf binder for the Information Reference Book of the present invention, showing a plurality of alphabetized and appendix sections.

FIG. 2 is a plan view of an abstract page removed from the appendix section of the binder of FIG. 1 for use as a recipe reference.

FIG. 3 is a plan view of an abstract form page removed from the appendix section of the binder of FIG. 1 for use as a general information reference.

BEST MODE FOR CARRYING OUT THE INVENTION

Referring more particularly to FIG. 1 of the drawing, the Information Reference Book embodying the principals of the present invention is generaly indicated by the reference numeral 10. The book utilizes a ring binder 11 having opposite front and back covers 12 and 14, respectively. Imtermediate the front and back covers, the binder has a ring mounting portion 15 supporting a plurality of spaced spring-loaded split rings, not shown, which are openable and closeable to transfer pages of the material within the binder as desired.

A plurality of divider panels 16 are disposed within the binder with each having an outwardly extended alphabetical tab 18 thereon, individually printed with letters of the alphbet from A through Z. The divider panels thereby separate the binder into a plurality of discrete spaces or alphabetized sections 19 in order to retrieve appropriately alphabetized information in a manner soon hereinafter to be described. An additional or auxillary divider panel 20 is provided adjacent to the back cover 14 of the binder 11 and has an appendix tab 21 outwardly extended therefrom to form a storage section 22 between it and the back cover.

As best shown in FIG. 2 a recipe abstract form having a plurality of punched holes 26 therein is provided for recording a variety of pertinent information with respect to a selected favorite recipe. A plurality of identical abstract form sheets are disposed within the form or appendix storage section 22 for use as needed upon identifying a recipe that is desired to be maintained for future use. At the top of each form a first space 27 is provided which has imprinted thereon the title "Category" for receiving a word under which the form can be alphabetized. A second space 28 is disposed immediately therebelow entitled "Recipe Name" for recording the name under which the recipe is generally known. The title "Cookbook Magazine or File" is provided as a heading to a third space 30 which extends approximately two-thirds across the form sheet below the recipe name space for recording the source of the selected recipe. The remaining one-third of the sheet to the right of space 30 is entitled "Page" and provides a fourth space 32 for recording the page number from the source within which the selected recipe has been chosen. A fifth space 33 extending approximately halfway across the sheet below space 32 is entitled "First Prepared" for recording the date the selected recipe was initially used. Filling the other half of the sheet to the right of space 33 is a space 34 entitled "Approximate Time to Prepare" under which the preparation and cooking time can be recorded. A space 35 entitled "Main Ingredients" is extended across the sheet for recording the appropriate information pertaining to any specialized or unusual ingredients contained within the recipe. The lower portion of the abstract form sheet provides a space 36 labelled "Comments" for recording other pertinent information concerning the reasons for selecting the particular recipe and other appropriate editorial comment.

A general information abstract form sheet 40 is shown in FIG. 3, a supply of which may also be stored within the appendix storage section 22 of the binder 11, providing a convenient supply of the forms for immediate use. At the top of this form there is also provided a "Category" space 42 for the same purpose as the similar space 27 for the recipe abstract form 25. Below that is provided a space 43 entitled "Name of Article" for precise identification thereof and a space 44 therebelow entitled "Source" for identifying that information. A space 45 entitled "Issue" is disposed below the source space and extends only halfway across the sheet to record the particular issue of the "Source" indicated above. The sheet to the right of space 45 includes a space 46 entitled "Page" identifying the particular page from the aforementioned source. A space 47 is provided under the title "Main Points of Interest" affording the opportunity to record the primary features or reasons for preserving the selected article. A "Comments" space 48 is provided at the lower portion of the form sheet similar to the Comments space 36 of the recipe form for recording any more detailed information concerning the article.

INDUSTRIAL APPLICABILITY

In operation, the ring binder 11 is set up as previously described with a supply of recipe abstract form sheets 25 and/or the general information abstract forms 40 within the form storage section 22 of the binder. Prior to any first use of the binder, the alphabetized sections 19 provided between the divider panels 16 are empty. It should be understood therefore that prior to use the full capacity of the binder would consist of the divider panels and a sufficient number of blank preprinted forms in the appendix section to completely fill the binder. After completion of the particular form, it is temporarily removd from the binder for transfer to an appropriate alphabetized section 19 for permanent residence behind its corresponding alphabetical tab 18. Accordingly, each time a recipe or interesting article is encountered that may be desirable to save, it only requires a moment to complete a form and to place it in alphabetical order.

The recording of appropriate information on the form sheets can be conveniently accomplished by first selecting a word to be recorded in the "category" section or space under which the form can be alphabetized for ready retrieval. In categories where there are large numbers of recipes for example, sub-categories can be devised particularly if there is more than one primary ingredient. In this case, a separate form may be provided with a "Category" listing for each major ingredient and then placed in each primary alphabetical category. The name of the recipe is recorded in space 28 and the source of such recipe designated under space 30, together with the page number in space 32. If reference is being made to a loose recipe, appropriate information can be recorded in the above described spaces corresponding to the location where such recipe is filed whether it be in a conventional recipe file or wherever located.

The fifth space 33 under "First Prepared" provides a space for recording the date when the recipe was initially tried so that such information is preserved for historical purposes which may be of particular interest to future generations in knowing when their ancestors first started making the old family favorites. In space 34 there should be recorded the approximate time to prepare the recipe, including preliminary steps prior to cooking, and particularly any unattended time involved; such as baking or simmering, or the like. Under space 35 only the primary ingredients need be listed, thus eliminating such minor ingredients as spices, seasonings, or the like, which are usually kept on hand unless the recipe calls for some more exotic ingredient that would need to be specifically obtained. The "Comments" section of space 36 enables the recording of any special secrets that make the recipe particularly desirable and may also serve as a reminder of things to do differently the next time the recipe is utilized. It may also be helpful to record any deviations from those given in the recipe which have been learned over past experience that would not be evident to someone using the recipe for the first time. Also, a list of companion dishes which accompany or blend well with the selected recipe could also be recorded. On the other hand, simply stating "Delicious" may be enough to tell the whole story with respect to how successfully the recipe has been received by friends and family.

The general information abstract form sheet 40 of FIG. 3 can be similarly utilized for recording other information of a more generic nature without departing from the scope and spirit of the primary recipe embodiment described above. The spaces 42 through 46 can be used to record the similar referencing information as before while space 47 and 48 can be utilized in the manner and in sufficient detail that reference to the original or full text of the article may be avoided in some instances.

In view of the foregoing, it is readily apparent that the present invention provides an improved information reference book and indexing system for preparing and storing abstracts of selected articles or favorite recipes and the like from a myriad of stored sources in one conveniently accessible location or depository.

I claim:

1. An information reference book for storing abstracted material from a larger source in a single depository comprising;

a looseleaf binder;

a plurality of dividers receivable within the binder and having alphabetical tabs of a predetermined relatively small size outwardly extended therefrom, and said dividers providing a plurality of alphabetized abstracting forms receiving spaces therebetween;

an auxiliary divider disposed within the binder and having an elongated tab outwardly extended thereform of a form and size larger than said alphabetical tabs;

a form storage space defined behind said auxiliary divider;

and a supply of unused abstract forms initially temporarily stored in said form storage space behind said auxiliary divider with said unused forms being transferable after use to appropriate ones of said alphabetized spaces in the binder.

2. The information reference book of claim 1 in which said binder includes front and back covers and an intermediate ring binder portion for releasably securing said dividers and abstract forms within said binder with said alphabetized dividers being located adjacent to said front cover and said supply of unused abstract forms being located adjacent to said back cover.

3. The information reference book of claim 2 wherein said abstract forms individually provide a plurality of titled information recording spaces preprinted thereon.

4. The information reference book of claim 3 wherein each pre-printed abstract form has a space for categorizing the abstracted information to determine its location for transfer into the appropriate alphabetized form receiving spaces within the binder;

and a plurality of additional spaces on the form for recording the name, source, location, main points and relevant comments regarding the original material of the larger source from which the abstracted information derived.

5. The information reference book of claim 4 in which each abstract form comprises a first space entitled "Category", a second space entilted "Name of Article", a third space entitled "Source", a fourth space entitled "Issue", a fifth space entitled "Page", a sixth space entitled "Main Points of Interest", and a seventh space entitled "Comments".

6. An information reference book, for storing in a single depository abstracted recipes from a larger library of cookbooks or other source material, comprising;

a looseleaf binder capable of storing a predetermined total volume of material therein;

a plurality of dividers receivable within the binder and having alphabetical tabs of a predetermined relatively small size outwardly extended therefrom, and said dividers providing a plurality of initially empty alphabetized abstracting form receiving spaces therebetween;

an auxiliary divider within the binder in following relation to said alphabetized dividers and having an elongated tab outwardly extended therefrom of a size and form larger than said alphabetical tabs;

a form storage space defined behind said auxiliary divider;

and a supply of usused abstract forms initially temporarily stored in said form storage space which in combination with said alphabetical dividers completely fill the binder to its total volume with said unused forms being individually transferable after use to appropriate ones of said alphabetized spaces without changing said total volume of material within the binder.

7. The information reference book of claim 6 in which said binder includes front and back covers and an intermediate ring binder portion for releasably securing said dividers and abstract forms within said binder with said alphabetized dividers being located adjacent to said front cover and said supply of unused abstract forms being located adjacent to said back cover.

8. The information reference book of claim 7 wherein said abstract forms individually provide a plurality of titled information recording spaces pre-printed thereon.

9. The information reference book of claim 8 wherein each pre-printed abstract form has a space for categorizing the selected abstracted recipe information to determine its location for transfer into the appropriate alphabetized form receiving spaces within the binder;

and a plurality of additional spaces on the form for recording the name, source, location, main points and relevant comments regarding the original recipe of the cookbook or other source from which the abstracted information derived.

10. The information reference book of claim 9 in which each abstract form comprises a first space entitled "Category", a second space entitled "Recipe Name", a third space entitled "Cookbook Magazine or File", a fourth space entitled "Page", a fifth space entitled "Main Ingredients", a sixth space entitled "Approximate Time to Prepare", a seventh space entitled "Main Ingredients", and an eighth space entitled "Comments".

11. A method of referencing for ready retrieval selected recipes, articles and the like from a myriad of sources into a single depository comprising the steps of;

utilizing a looseleaf binder capable of storing a predetermined total volume of material therein and having an initially empty alphabetized section and an initially completely filled unused form storage section;

selecting an abstract form from a supply of such unused forms temporarily disposed in filling relation to said storage section of the binder;

recording on the selected unused form a summary of information pertinent to the selected recipe or article;

and after completion transferring said selected form from the temporary storage section to an appropriate permanent location in the alphabetized section of the binder for maintenance within the single depository without changing said total volume of material within the binder.

* * * * *